US010568379B2

(12) United States Patent
Sneed et al.

(10) Patent No.: US 10,568,379 B2
(45) **Date of Patent: *Feb. 25, 2020**

(54) SPORTS HELMET WITH SHOCK ABSORBER SYSTEM

(71) Applicants: Nevin A Sneed, Houston, TX (US); Niles J. Sneed, Houston, TX (US)

(72) Inventors: Nevin A Sneed, Houston, TX (US); Niles J. Sneed, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/398,619

(22) Filed: Apr. 30, 2019

(65) Prior Publication Data

US 2019/0255420 A1 Aug. 22, 2019

(51) Int. Cl.
*A63B 71/10* (2006.01)
*A42B 3/20* (2006.01)

(52) U.S. Cl.
CPC ..... *A42B 3/20* (2013.01); *A63B 71/10* (2013.01)

(58) Field of Classification Search
CPC .... A42B 1/08; A42B 3/00; A42B 3/04; A42B 3/08; A42B 3/18; A42B 3/185; A42B 3/20; A42B 3/22; A63B 71/10; A63B 2071/105
See application file for complete search history.

(56) References Cited

U.S. PATENT DOCUMENTS 1,203,564 A * 11/1916 April ..... A42B 3/20 2/9
3,170,164 A * 2/1965 Holder ..... A42B 3/20 2/9
5,101,517 A 4/1992 Douglas
5,675,875 A * 10/1997 Servatius ..... A42B 3/20 2/424
5,956,777 A * 9/1999 Popovich ..... A42B 3/20 2/412
6,378,140 B1 4/2002 Abraham
7,607,179 B2 * 10/2009 Shih ..... A42B 3/20 2/411
8,756,719 B2 6/2014 Veazie
9,289,024 B2 3/2016 Withnall
9,370,216 B2 * 6/2016 Brantley ..... A42B 3/20
2007/0151003 A1 7/2007 Shih
2008/0163410 A1 7/2008 Udelhofen
2011/0209272 A1 9/2011 Drake
2013/0111654 A1 * 5/2013 Gorsen ..... A42B 3/205 2/421
2014/0325744 A1 * 11/2014 Klein ..... A42B 3/20 2/411
2015/0135413 A1 * 5/2015 Mayerovitch ..... A42B 3/125 2/414
2015/0201695 A1 * 7/2015 Shih ..... A63B 71/10 2/9

(Continued)

*Primary Examiner* — Daniel J Wiley

(74) *Attorney, Agent, or Firm* — Law Office of Alexis J Saenz

(57) ABSTRACT

A helmet is disclosed for sports that protects the wearer from impact that may cause head trauma. The helmet includes a recoiling shock absorber system on one or more portions likely to sustain direct blows. The shock absorber system may move omnidirectionally in response to the line of force received at impact by a facemask connected to the shock absorber. Impact to the portion of the helmet receiving a hit may be dissipated through the shock absorber system and distributed into the remaining shell of the helmet.

8 Claims, 7 Drawing Sheets

(56) References Cited

U.S. PATENT DOCUMENTS

| | | | | |
|---|---|---|---|---|
| 2015/0230533 | A1* | 8/2015 | Bancroft | A42B 3/20 2/424 |
| 2016/0374424 | A1* | 12/2016 | Gowen | A42B 3/08 2/421 |
| 2017/0042273 | A1* | 2/2017 | Fletcher | A42B 3/20 |
| 2017/0056752 | A1* | 3/2017 | Tubbs | A42B 3/20 |

* cited by examiner

SPORTS HELMET WITH SHOCK ABSORBER SYSTEM

CROSS-REFERENCE TO RELATED APPLICATIONS

This application claims benefit under 35 U.S.C. § 119(e) of U.S. application Ser. No. 15/462,748 filed Mar. 17, 2017 which claims the benefit of priority from U.S. Provisional Application having Ser. No. 62/309,963 filed Mar. 18, 2016, which are hereby incorporated by reference herein in their entirety.

FIELD

The subject disclosure relates to sporting goods, and more particularly, to a sports helmet with a shock absorber system.

BACKGROUND

In sports, helmets are designed primarily to protect the head from direct contact by other pieces of sports equipment while playing. American Football is receiving particular attention of late because of the latent trauma experience by players on a long-term basis in addition to the immediate trauma to the brain suffered by concussive impacts. Previous protective American Football sporting helmets are designed to protect the head from cranial fractures and sports related concussions (SRC) stemming from impact received by the player initiating the force or receiving the force by increasing the technology of the helmet itself.

The previous helmets designers aimed at reducing concussive force by crafting a soft helmet outer surface with harder inner shell, a hard exterior with softer interior cores, a facemask with bending technologies, or a facemask with energy/shock absorbing clips that assist in slowing impacts received from the front (head on, directly into the players facial region).

Some facemask systems have been designed to reduce the impact of straight on facemask to facemask collisions. However, as is understood by those who actually play the game, straight on facemask to facemask collisions are only a small percentage of the type of impact between players' helmets. Generally this design may be ineffective at reducing impact that is not straight on between opposing facemasks.

As can be seen, there is a need for a helmet that improves upon reducing the concussive impact to the head and brain experienced by athletes during sports.

SUMMARY

In one aspect of the disclosure, a sports helmet comprises a main shell, a facemask, and a recoil based shock absorber system connecting the facemask to the main shell. The recoil based shock absorber system is configured to move omnidirectionally in response to an impact force received by the facemask.

In another aspect, facemask system comprises a uni-body facemask frame. A recoil based shock absorber system is attached to the facemask frame. A coupler is connected to the facemask frame. The coupler is configured to attach the facemask frame to a helmet shell. The recoil based shock absorber system is configured to move omnidirectionally in response to an impact force received by the facemask frame when connected to the helmet shell and the facemask frame is configured to move multidirectionally when connected to the helmet shell in response to the impact force received.

In still yet another aspect, a shock absorber system for attachment between a facemask frame and a helmet shell comprises a recoil based shock absorber assembly. A coupler for connection to the facemask frame and the helmet shell is configured to attach the facemask frame to the helmet shell. A stem is included for connecting the coupler to the facemask frame. A spring is connected to a distal end of the stem. The spring is configured to move omnidirectionally in response to an impact force received by the facemask frame and transmitted to the stem and spring through the facemask frame.

It is understood that other configurations of the subject technology will become readily apparent to those skilled in the art from the following detailed description, wherein various configurations of the subject technology are shown and described by way of illustration. As will be realized, the subject technology is capable of other and different configurations and its several details are capable of modification in various other respects, all without departing from the scope of the subject technology. Accordingly, the drawings and detailed description are to be regarded as illustrative in nature and not as restrictive.

DETAILED DESCRIPTION

Figure 2:
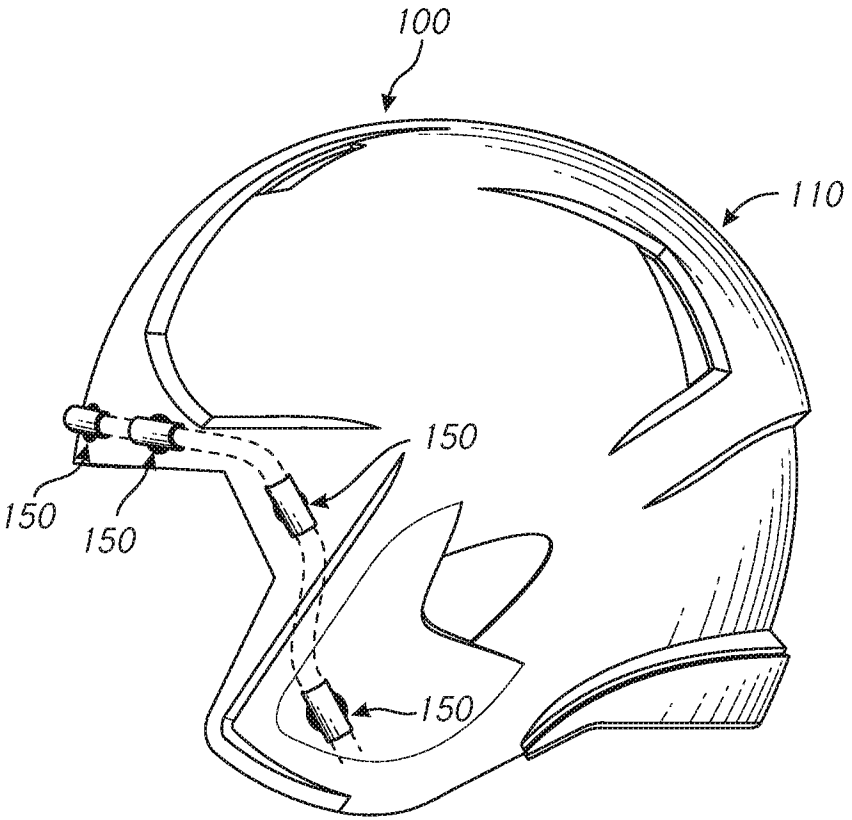
FIG. 2 is a side view of the helmet of FIG. 1.

The detailed description set forth below is intended as a description of various configurations of the subject technology and is not intended to represent the only configurations in which the subject technology may be practiced. The appended drawings are incorporated herein and constitute a part of the detailed description. The detailed description includes specific details for the purpose of providing a thorough understanding of the subject technology. However, it will be apparent to those skilled in the art that the subject technology may be practiced without these specific details. Like or similar components are labeled with identical element numbers for ease of understanding.

In general, exemplary embodiments of the subject technology provide a helmet that protects the wearer from impact that may cause head trauma. Aspects of the helmet disclosed may be particularly useful for football but it will be understood that any sport with potential for impact to the head may benefit from the subject technology. The helmet includes a recoiling shock absorber system that moves along different axes to absorb forces from more hitting for example the facemask at different angles. The shock absorber systems may be on one or more portions of the helmet likely to sustain contact, absorbing force independent of the source direction of contact, which may be transferred to the brain if not mitigated. As will be appreciated, aspects of the subject technology protect the wearer by absorbing force along various directions of impact as is commonly encountered in the sport of football. A user may see a player coming straight at him but in actual gameplay may experience a hit from below the facemask, just to the side of the facemask or from the side of the helmet as other players for example converge on the player. Helmets using the subject technology provide a piece of safety equipment to protect the head and most importantly the brain by functioning to absorb impact forces which attempt to act upon the whole human head and brain when the helmet is hit from the front, sides or from the ground upward. Impact to the portion of the helmet receiving a hit may be dissipated through the shock absorber system and distributed into the remaining shell of the helmet.

In one aspect, the facemask portion according to exemplary embodiments of the present invention distinguishes over the present state of the art of facemasks developed of the type referred to in the Background by providing a facemask uni-body frame construction formed of a single piece of material such as metal (for example, aluminum), hard plastic, or like materials. In some embodiments, the facemask may be coated with a suitable plastic coating (TPU) or rubber. The facemask may also move in any direction to counter forces from the moment of receiving a blow being struck thereon to substantially absorb the resulting shock before the helmet itself is forced to distribute the impact. The multi-directional shock-absorption allows the facemask to be pushed upward if the blow comes from beneath the fast mask, left or right to counter points of impact from any side, or any other direction to counter the point of impact. The technologies within the multi-point directional shock absorber system include for example spring assemblies or cushion assemblies attached to the facemask to respond to the point of impact.

Figure 1:
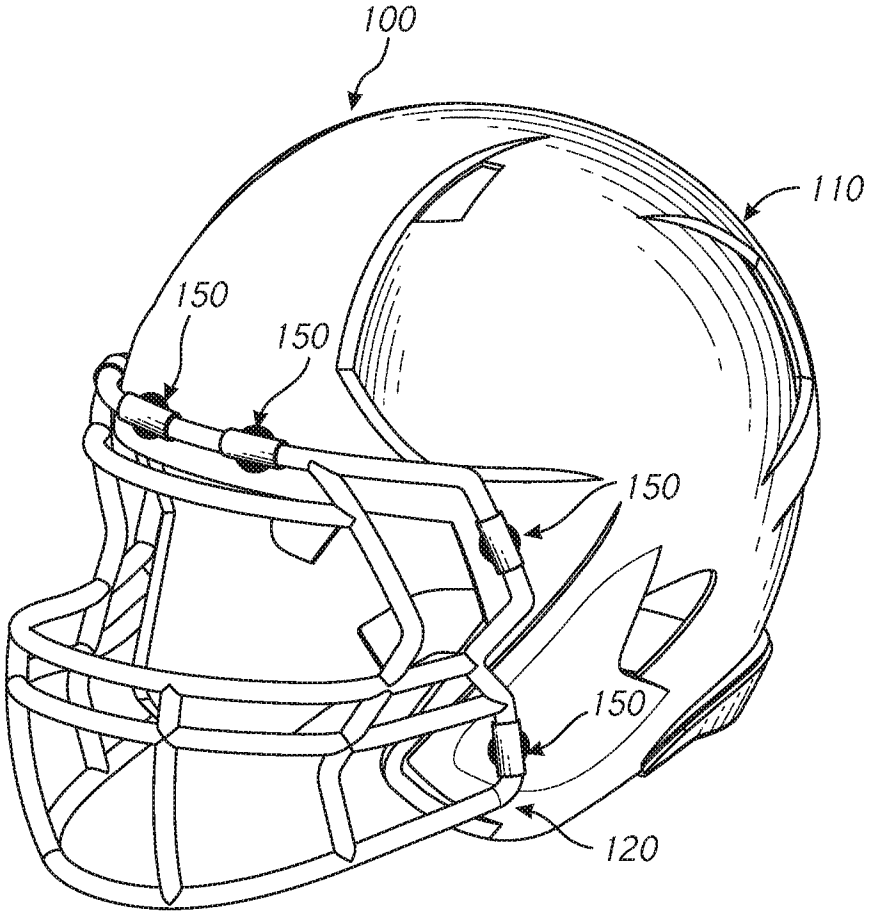
FIG. 1 is a perspective, side view of a sports helmet with a shock absorber system in accordance with an aspect of the subject technology.

Referring now to FIGS. 1 and 2, a sports helmet 100 (referred to generally as the "helmet 100") is shown according to an exemplary embodiment of the present invention. The helmet 100 includes a main shell 110 similar to the shell construction of a conventional sports helmet but modified to improve distribution of impact forces to the user's head. The shell 110 includes shock absorber systems 150 to portions of the helmet 100 that are likely to receive impact resulting in concussive forces to the head. The shock absorber systems 150 may be integrated into the shell 110 however other embodiments may provide a retrofit capability to existing conventional shells as will be described below with respect to FIGS. 12-15. As will be appreciated, the shock absorber systems 150 may move in three dimensional space. The shock absorber systems 150 are configured to move omnidirectionally or at least multi-directionally. Omnidirectional movement may mean capable of moving within a spherical coordinate system as defined by a radial distance from a central point in relation to an azimuthal angle and polar angle from the point. Multi-directional movement may be defined as being capable of moving along more than one plane including for example, radially, axially, longitudinally, and orthogonal to any of the radial, axial, and longitudinal axes from a central point of the shock absorber system 150. In an exemplary embodiment, a facemask 120 is attached at various points to the helmet shell 110 using the shock absorber systems 150 so that when impacted, the facemask 120 may move along any of the same lines of impact receiving a blow to the helmet 100. Some embodiments may include a protective layer over the shock absorber systems 150 (for example a webbing) to protect the internal components from damage if contacted by for example a person's fingers. Some embodiments may include a layer of thermal polyurethane covering the majority if not all of the shell 110. The TPU layer may help cushion and distribute impact forces around the exterior of the shell 110. The shock absorber systems 150 (along with alternate embodiments) are described in further detail below with respect to FIGS. 3-11.

Figure 3:
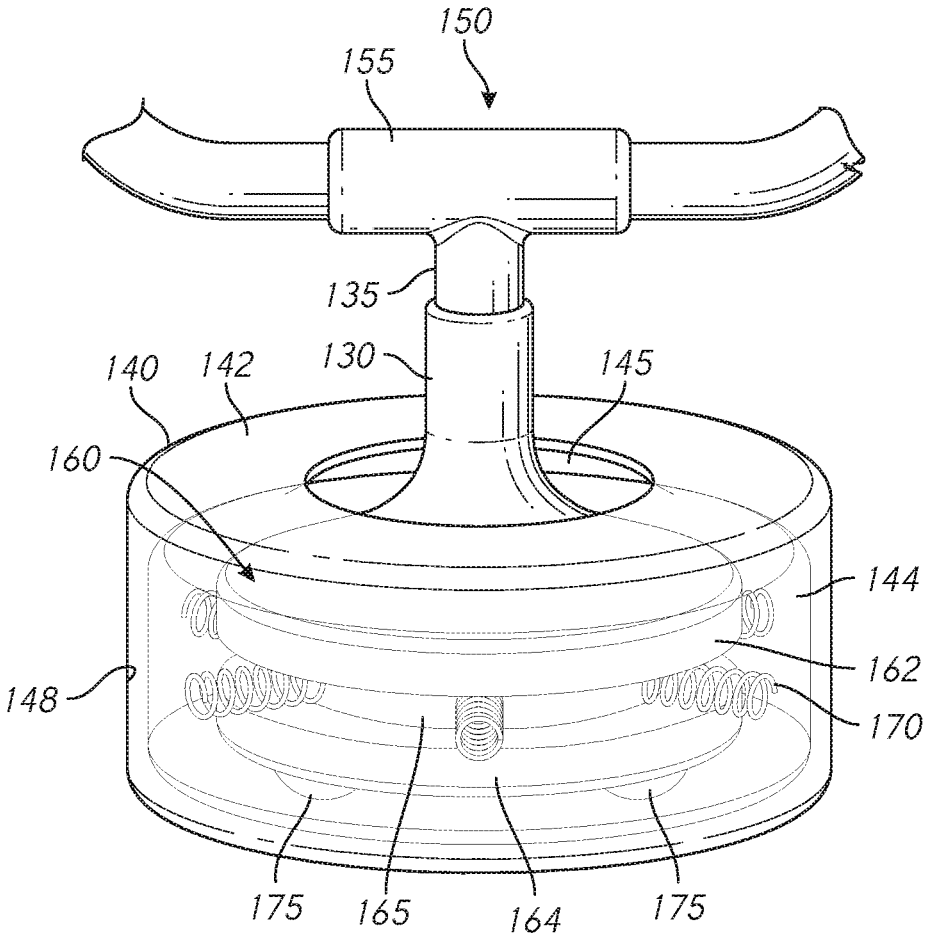
FIG. 3 is a front view of a shock absorber system connected to a facemask section in accordance with an aspect of the subject technology.
Figure 4:
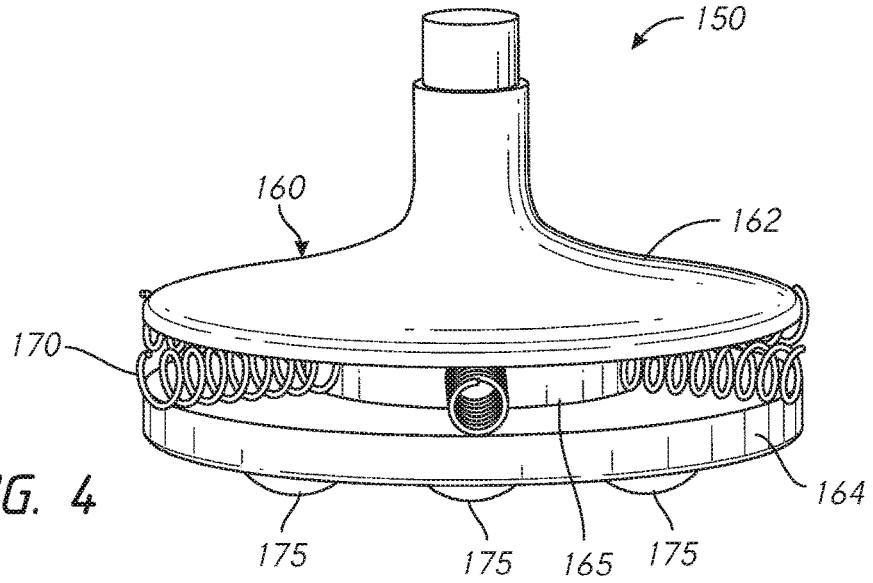
FIG. 4 is a front view of a shock absorber system of FIG. 3 outside of a shell and disconnected from the facemask portion.
Figure 5:
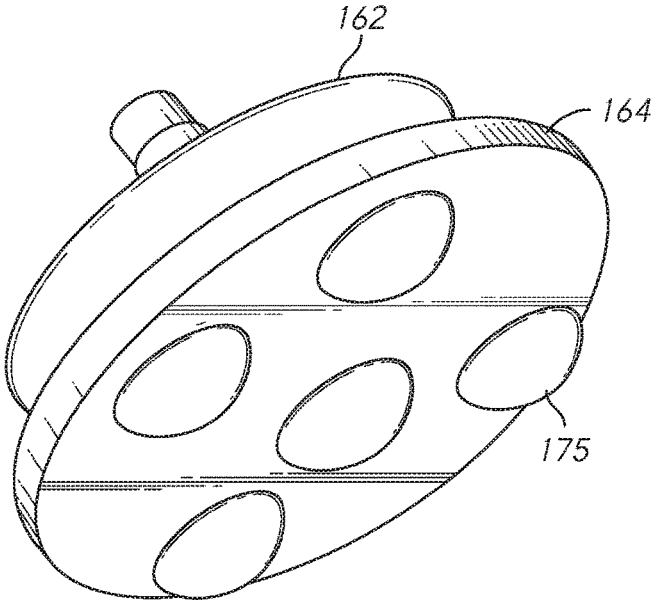
FIG. 5 is a bottom perspective view of the shock absorber system of FIG. 3 with springs hidden from view.

FIGS. 3-5 show an enlarged view of a shock absorber system 150 according to an exemplary embodiment. The shock absorber system 150 may be connected to a portion of the facemask by a tee coupler 155. A stem 135 of the tee coupler 155 may be connected to a shock absorber assembly 160 which may include for example a disk shaped head 162 (similar to a poppet valve) spaced from a disk shaped base 164. The shock absorber assembly 160 may be housed within a cylindrical shell 140. The shell 140 may represent a section of the helmet shell 110 in embodiments where the shock absorber system 150 is integrated into the helmet 100. A top surface 142 of the shell 140 includes a central opening 145. A sleeve 130 projects outward from the shock absorber assembly 160 through the central opening 145. The sleeve 130 may be hollow for receipt of the stem 135 therein. The shell 140 may include a solid interior 148 with an inner wall 144 defining a cavity indexed to the shape of the shock absorber assembly 160. In an exemplary embodiment, a set of bearings 175 may be positioned on a bottom side of the disk base 164 in contact with a bottom floor of the shell 140 allowing the shock absorber assembly 160 to roll laterally in any direction across the plane of the shell 140 floor. Forces of impact that are received primarily along the axis from the tee coupler 155 through the stem 135, the sleeve 130, and through the central point of the head 162 and base 164 may be absorbed by said elements along this axis as described in more detail below with respect to FIGS. 10 and 11.

In an exemplary embodiment, a spring 170 is attached to the shock absorber assembly 160 to move the system 150 radially (or omnidirectionally depending on the structure used) from an axis defined by the stem 135 (or sleeve 130) intersecting orthogonally with the horizontal or flat plane of the spring 170 (or base 164). In an exemplary embodiment, a coupling ring 165 may occupy the space between the disk shaped head 162 and base 164. A set of springs 170 may project radially outward from the coupling ring 165 into contact with the inner wall 144. The springs 170 may be symmetrically positioned around the coupling ring 165 to provide equal resistance in 360 degrees of horizontal (radial) coverage around the spring assembly 160. For sake of illustration, six springs 170 are used with five springs 170 being in view (FIG. 3) and a sixth spring 170 being hidden in the rear of the assembly 160. However it will be understood that more or less springs 170 may be used to provide the symmetrical absorption coverage from multiple directions of impact.

As will be appreciated, the shock absorber system 150 is able to move and absorb impact in at least three dimensions (radially in all directions from the axis travelling through and intersecting the center of the head 162 and the center of the base 164 and axially along that same axis). The set of bearings 175 allow the shock absorber assembly 160 to be displaced laterally in any direction 360 degrees from its default center point. The spring(s) 170 may absorb/resist some of the impact from a collision with the facemask as the shock absorber assembly 160 is pressed into the inner wall 144. The spring force of spring(s) 170 may return the shock absorber assembly 160 back to its default position after impact. The bulk of impact absorption may be provided by shock absorber assembly 160. In operation, as an impact force is received by the facemask 120, the force is transmitted through the facemask portion(s) down the stem 130 to the shock absorber assembly 160. The shock absorber assembly 160 may absorb some of the force and redistribute forces/energy into the shell 140 which in turn may distribute the energy into and around the surrounding shell 110, thus redirecting force around the helmet and circumventing forces applied directly to the user's cranium.

Figure 6:
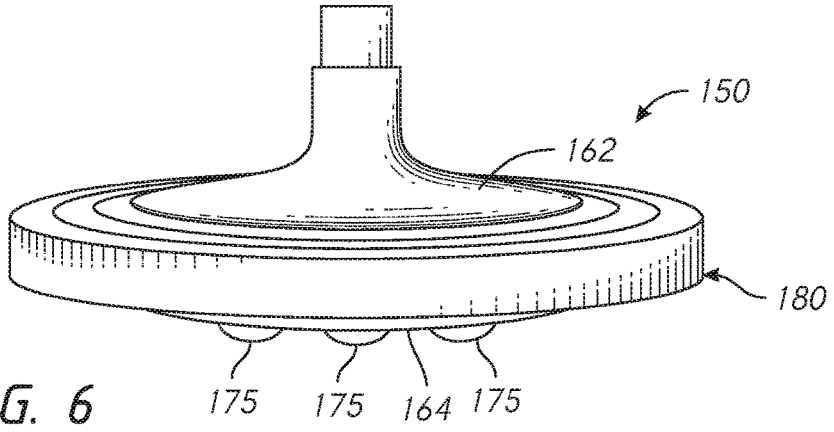
FIG. 6 is a front perspective view of a shock absorber system including a shock absorber disk in accordance with an alternate embodiment.
Figure 7:
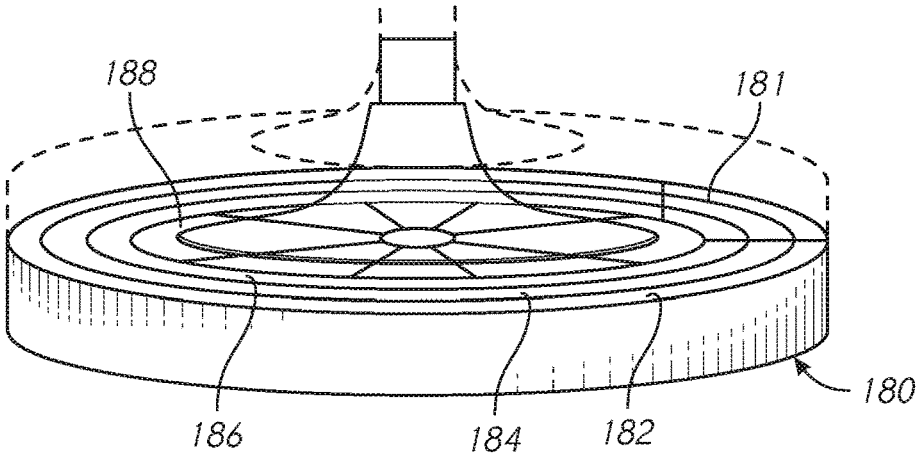
FIG. 7 is a front perspective view of the shock absorber disk of FIG. 6 removed from the shock absorber system.

In addition, some embodiments may use springs other than helical type springs as shown. Referring now to FIGS. 6 and 7, the shock absorber system 150 is shown using another spring type shock absorber that moves omnidirectionally or at least multi-directionally, which may be in the form of a disk (referred to herein as "the shock absorber disk 180"). The shock absorber disk 180 may occupy the space between the head 162 and base 164 instead of (or in addition to) the radially projecting springs 170. The shock absorber disk 180 may be a flexible material such as rubber, foam, gel or similar material with force absorbing and dissipating properties. The generally annular shape of the shock absorber disk 180 may receive the impact force from any direction and distribute the force throughout the disk 180 primarily along the line of force into the helmet shell 110. In an exemplary embodiment, the shock absorber disk 180 may include multiple annular layers 182, 184, 186, and 188 of elastomers (such as rubber) or thermoplastic polyurethanes (TPUs) (or combinations thereof). For sake of illustration, only four layers are shown however it will be understood that embodiments may use two or more layers with the effectiveness of the shock absorber disk 180 increasing with the addition of more layers. The layers 182, 184, 186, and 188 may use different grades/types of material with increasing stiffness, strength, and/or toughness from the innermost layer 188 having less stiffness, strength, and/or toughness than the outermost layer 182. In operation, as an impact is being received, the stronger the force of impact, the more resistance the shock absorber system 150 experiences as the head 162 and base 164 travel farther into the layers 182, 184, 186, and 188. Thus, more force is converted into energy that is transferred into the surrounding shell 110 (FIGS. 1 and 2). In addition, as will be appreciated, as the center of the shock absorber system 150 is moved along a line of force, the force starting from the center may be distributed into an increasing area (for example, the arc section 181) of the layers 182, 184, 186, and 188 the farther into the layers the force travels thus dissipating the force over a larger surface area of absorbing material. In addition, it will be understood that alternate embodiments of the shock absorber disk 180 may use the same material for each layer but may vary the thickness to achieve the effect of increasing stiffness, strength, and/or toughness.

Figure 8:
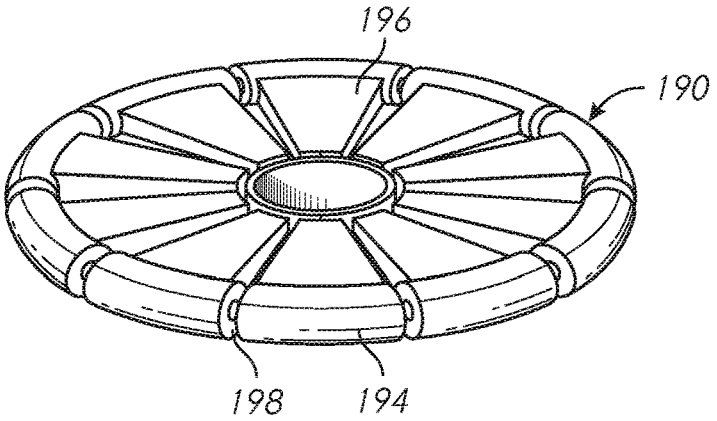
FIG. 8 is a front perspective view of a shock absorber disk in accordance with another alternate embodiment.

Referring now to FIG. 8, a shock absorber disk 190 is shown according another embodiment which may be substituted for (or used in combination with) the springs 170. The shock absorber disk 190 includes a plurality of wedges including an inner wedge section 196 bounded by an outer bumper 194. The 196 wedge may also comprise differing grades of shock absorbing materials, allowing the wedge section to mitigate impact forces by collapsing less or further under varying levels of impact, before transferring the force to the outer bumper 194. The wedges may be generally spaced from each other but may be connected along the periphery through respective bumpers 194. A central ring (which couples the shock absorber disk 190 to the sleeve 130 of FIG. 3 (or another post within the sleeve 130)) provides a common anchor point for the inner points of respective wedges. The outer bumper 194 may be stiffer, stronger, and/or tougher than its inner wedge section 196 so that similar to the shock absorber disk 180 (FIGS. 6 and 7), the stronger the impact, the higher the energy absorption provided by the shock absorber disk 190. After receiving an impact, the bumper(s) 194 may bounce back from the inner wall 144 (FIG. 3) and return the shock absorber disk 190 back to its default position.

Figure 9:
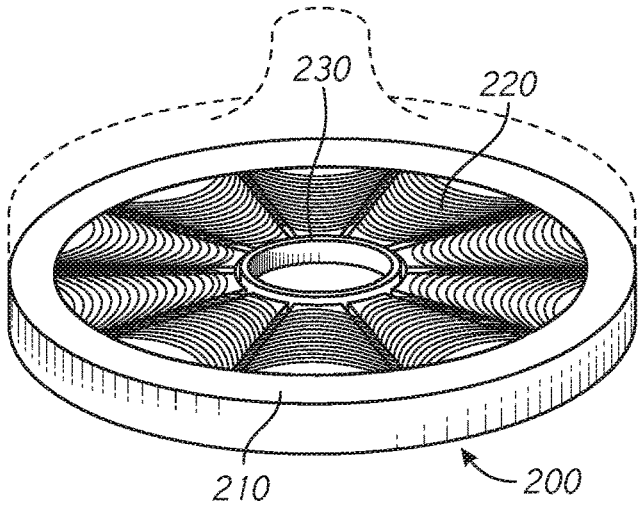
FIG. 9 is a front perspective view of a shock absorber disk in accordance with still yet another alternate embodiment.

Referring now to FIG. 9, a shock absorber disk 200 is shown according another embodiment which may be substituted for (or used in combination with) the springs 170. The shock absorber disk 200 includes a biomimetic based design. In an exemplary embodiment, medusoid based arc shaped sections of chained spring links 220 bounded by a supporting outer ring 210 and a central anchor ring 230. Other examples of biomimetic based spring designs include micro-lattices, jelly fish elastomer designs, or honey comb spring designs. The springs may be for example metallic, rubber, or a combination of materials. The sections of medusoid spring links 220 may be configured into an orb web shape so that the innermost springs have a smaller concave curvature than the outermost springs. As such, as the inner ring 230 is moved farther outward as a result of impact to the facemask 120 (FIGS. 1 and 2), the inner ring 230 encounters increasing resistance from the increasing number of springs being pushed into each other in the radial direction as well as the larger spring force encountered by the increasing size of springs toward the outer edges. As will also be appreciated, the shock absorber disk 200 provides the resistance to and absorption of impact in every radial direction from the central point.

Figure 10:
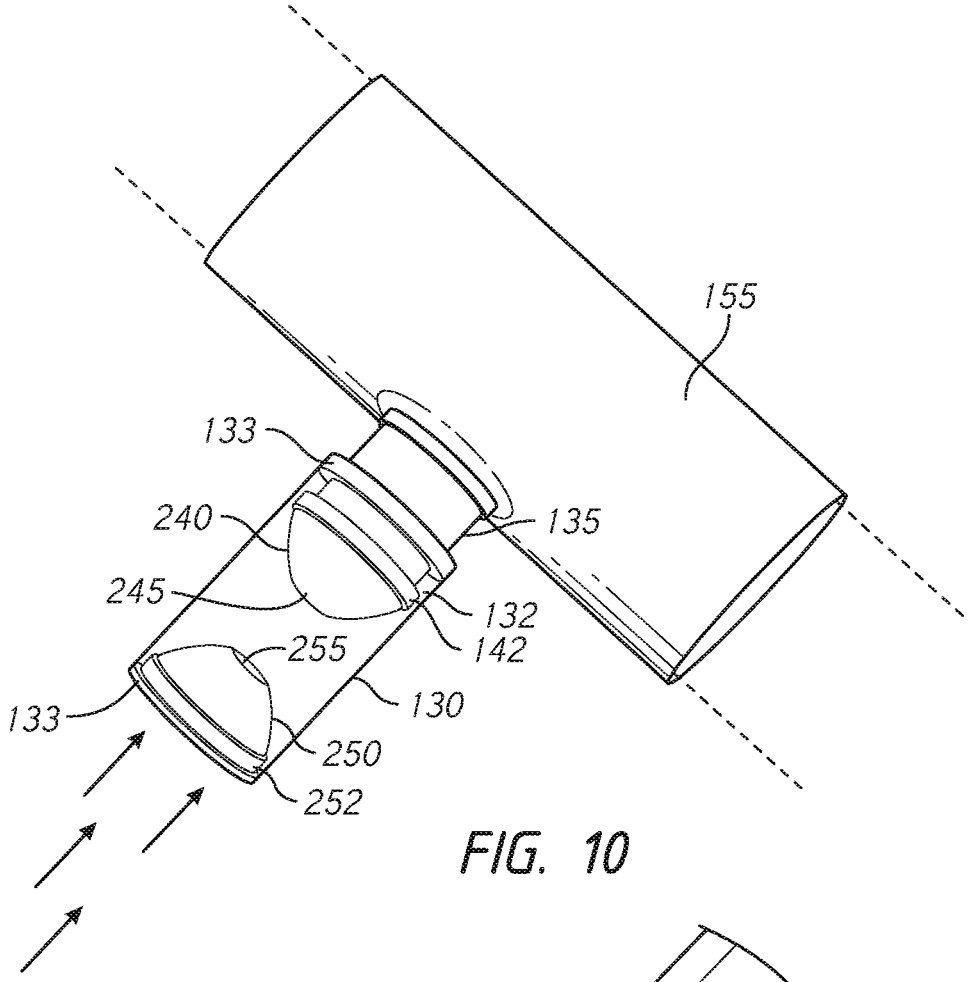
FIG. 10 is an enlarged partial view of a connection between a shock absorber system to a facemask section with shock absorbing buttons in a separated position in accordance with an aspect of the subject technology.
Figure 11:
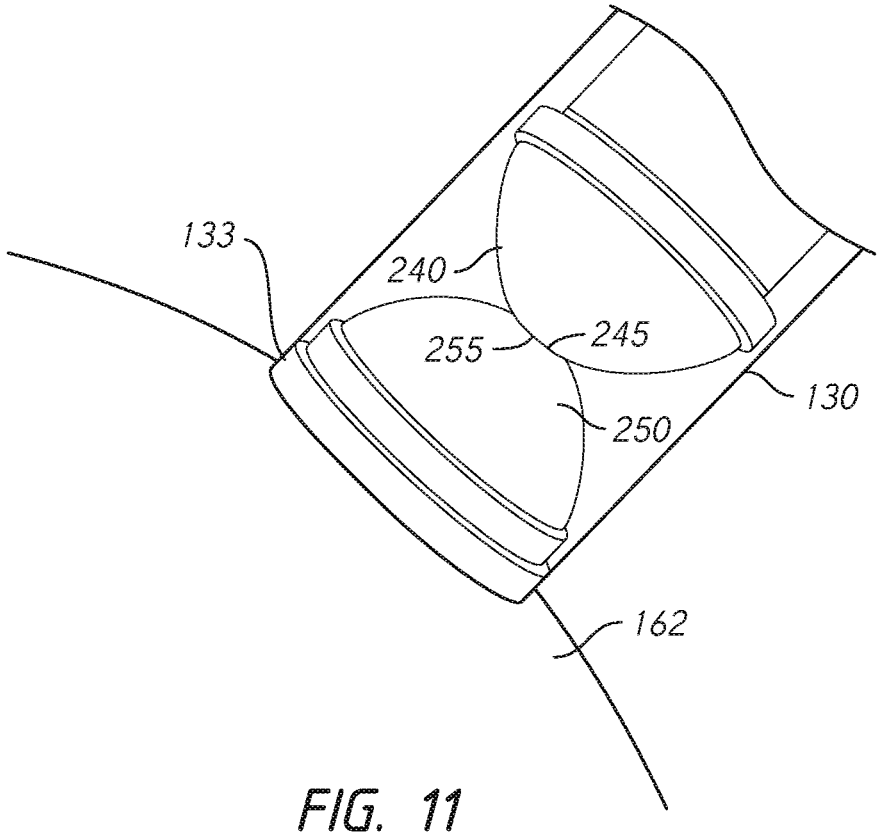
FIG. 11 is an enlarged view of the connection of FIG. 10 with the shock absorbing buttons in a contact position.

In another aspect and as shown in FIGS. 10 and 11, impact that is orthogonal (or at least perpendicular) to the head 162 or flat surfaces of the shock absorber disks 180, 190, or 200 may be mitigated by a pair of dashpots 240 and 250 (or other dampener type or shock absorber) in linear opposition of each other. The dashpot 240 may be on the distal end of the stem 135. The dashpot 250 may be coupled to the distal projection of absorber head 162. The dashpots 240 and 250 may be housed within an interior 132 of the sleeve 130 in opposition of each other. The dashpots 240 and 250 may hold within the interior of their respective connections (stem 135 and head 162 end) a compressible fluid to absorb and dissipate kinetic energy. The dashpot 240 may include a collar 142 sized to prevent the dashpot 240 from passing through a lip 133 within the sleeve 130. The dashpot 250 may similarly include a collar 252 to prevent escape past a lip 133 on the opposite end of the sleeve 130. The dashpot 240 may include a dimple 245 and likewise, opposing dashpot 250 may include a dimple 255. As will be appreciated, the elements described in FIGS. 10 and 11 contribute to movement in the axially direction providing part of the three dimensional absorption of forces along different planes.

Depending on how a user may wish to setup the shock absorber system 150, either of FIG. 10 or FIG. 11 may represent a default position of the dashpots 240 and 250. For example, FIG. 10 represents a default position where the opposing dashpots 240 and 250 are spaced before impact. In response to an impact force applied to the side of the facemask 120 (known as being "ear holed") (FIGS. 1 and 2) or to the top of the facemask 120, the respective shock absorber systems 150 may travel linearly into the helmet shell 110. FIG. 11 then depicts that the dashpot 240 travels into the dashpot 250 within the sleeve 130 to help cushion the impact axially into the shock absorber system 150. The dimples 245 and 255 help provide a dampening (or shock absorbing) effect upon contact with each other. In another example, FIG. 11 represents a default position where the dashpots 240 and 250 are in contact. In response to an impact force applied to a side of the facemask 120 that is opposite the shock absorber system 150, (for example, if a person is hit from their right side of the facemask 120, the following description is referring to a shock absorber system 150 on the left side of the facemask 120), the dashpots 240 and 250 may disengage to provide movement of the facemask 120 away from the helmet so that energy travelling axially within the shock absorber system 150 is directed outward and away from the helmet 100 (FIGS. 1 and 2).

Figure 12:
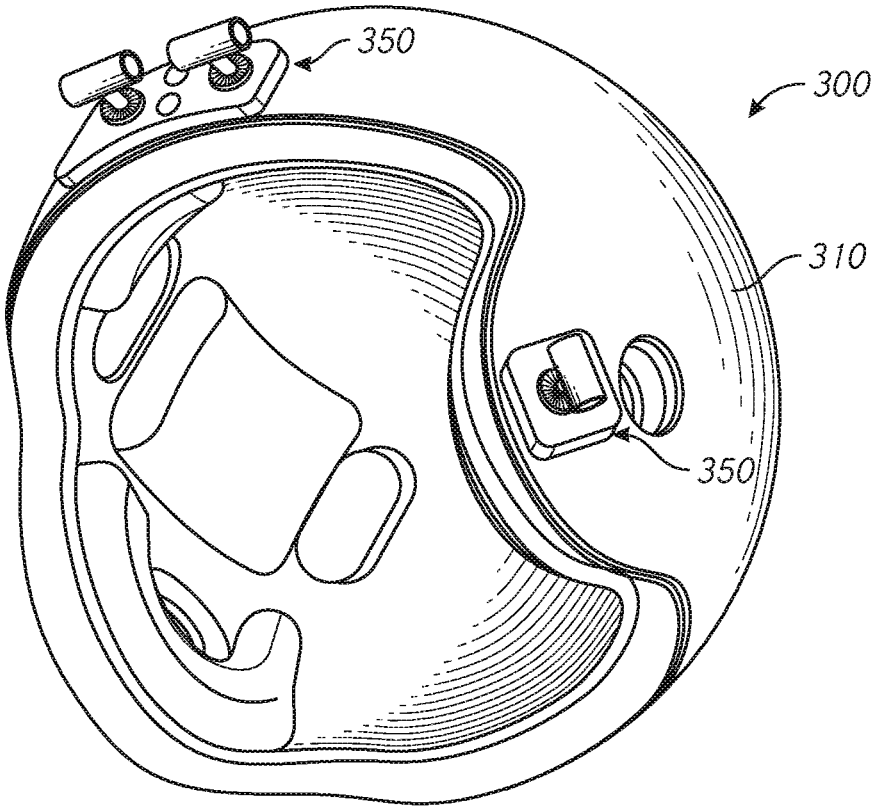
FIG. 12 is a bottom perspective view of a sports helmet retrofit with shock absorber systems in accordance with an aspect of the subject technology.
Figure 13:
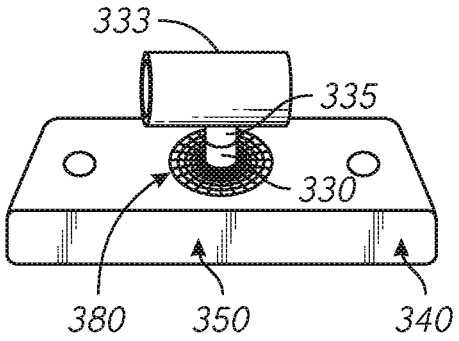
FIG. 13 is a front perspective view of a shock absorber system module of FIG. 12.
Figure 14:
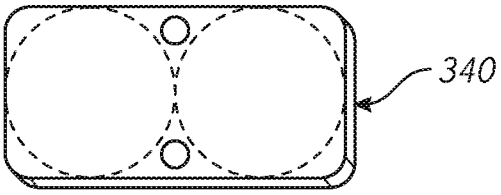
FIG. 14 is a bottom view of the shock absorber system module of FIG. 12 with underlying shock absorber system positions shown in dashed lines.

Referring now to FIGS. 12-14, a helmet 300 is shown according to an exemplary embodiment of the present invention. The helmet 300 may be a system that includes a helmet shell 310 and a modular shock absorber system 350 that is detachable to the shell 310 via a shell interface block 340. It may be appreciated that the embodiment disclosed may retrofit to existing helmet shells with little modification. The modular shock absorber system 350 may be similar to the shock absorbing system 150 disclosed in the embodiments of FIGS. 1-11 above. A tee coupler 333, sleeve 330, and stem 335 may be included for connecting a facemask to the modular shock absorber system 350. A netting or other protective cover 380 may protect internal components from damage. Through holes may be included to receive standard helmet screws to attach the modular shock absorber system 350 to existing holes present in pre-existing helmets.

Figure 15:
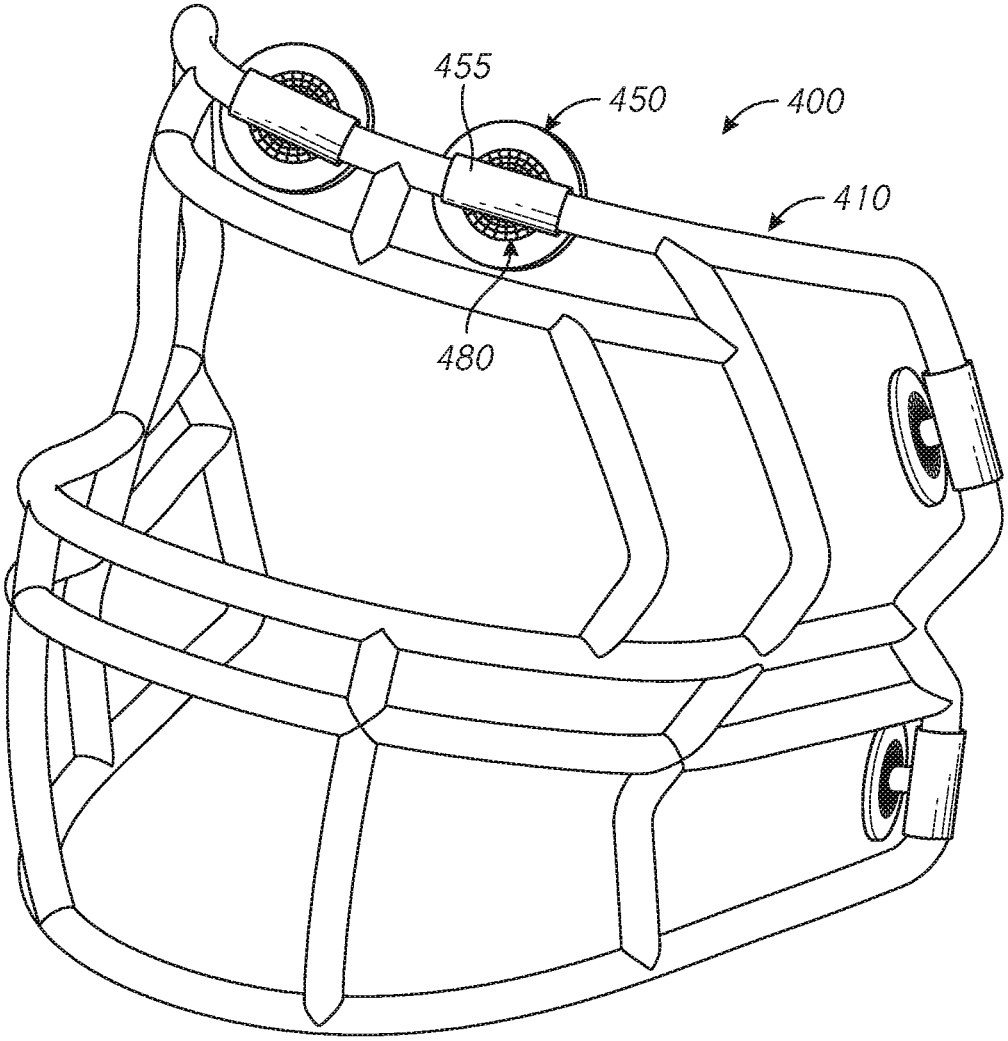
FIG. 15 is a front perspective view of a facemask retrofit with shock absorber systems in accordance with an aspect of the subject technology.

Referring now to FIG. 15, a facemask system 400 for retrofitting shock absorber systems 450 onto a pre-existing helmet (not shown) is shown according to an exemplary embodiment. The facemask 400 may include a tee coupler 455 that attaches shock absorber systems 450 onto various points of the facemask 410. The shock absorber systems 450 may include a substrate (unmarked) that may be used to attach the facemask 410 to parts of a helmet that already have pre-existing attachment points for conventional facemasks.

As will be appreciated, the benefits of the shock absorber systems described herein are readily provided to pre-existing helmets and facemask by the retrofit embodiments described here.

As will be further appreciated, the embodiments disclosed above provide helmets that perform better by providing better head and brain cushion and protection by absorbing impact forces which originate from above, below, or in front of the facemask or facial covering. Thus the speed at which the brain is traveling towards the cranium is decreased when contact to the head occurs helping to return the brain to its natural position and thereby enabling the Cerebral Spinal Fluid, CSF, to recover and return to its natural position around the brain stabilizing and cushioning the brain from cranial contact. This will ultimately result in a decreased incidence rate of concussions or other forms of head trauma caused by impact to the head.

Those of skill in the art would appreciate that various components and blocks may be arranged differently (e.g., arranged in a different order, or partitioned in a different way) all without departing from the scope of the subject technology.

The previous description is provided to enable any person skilled in the art to practice the various aspects described herein. The previous description provides various examples of the subject technology, and the subject technology is not limited to these examples. Various modifications to these aspects will be readily apparent to those skilled in the art, and the generic principles defined herein may be applied to other aspects. Thus, the claims are not intended to be limited to the aspects shown herein, but is to be accorded the full scope consistent with the language claims, wherein reference to an element in the singular is not intended to mean "one and only one" unless specifically so stated, but rather "one or more." Unless specifically stated otherwise, the term "some" refers to one or more. Pronouns in the masculine (e.g., his) include the feminine and neuter gender (e.g., her and its) and vice versa. Headings and subheadings, if any, are used for convenience only and do not limit the invention.

Terms such as "top," "bottom," "front," "rear," "above," "below" and the like as used in this disclosure should be understood as referring to an arbitrary frame of reference, rather than to the ordinary gravitational frame of reference. Thus, a top surface, a bottom surface, a front surface, and a rear surface may extend upwardly, downwardly, diagonally, or horizontally in a gravitational frame of reference. Similarly, an item disposed above another item may be located above or below the other item along a vertical, horizontal or diagonal direction; and an item disposed below another item may be located below or above the other item along a vertical, horizontal or diagonal direction.

A phrase such as an "aspect" does not imply that such aspect is essential to the subject technology or that such aspect applies to all configurations of the subject technology. A disclosure relating to an aspect may apply to all configurations, or one or more configurations. An aspect may provide one or more examples. A phrase such as an aspect may refer to one or more aspects and vice versa. A phrase such as an "embodiment" does not imply that such embodiment is essential to the subject technology or that such embodiment applies to all configurations of the subject technology. A disclosure relating to an embodiment may apply to all embodiments, or one or more embodiments. An embodiment may provide one or more examples. A phrase such an embodiment may refer to one or more embodiments and vice versa. A phrase such as a "configuration" does not imply that such configuration is essential to the subject technology or that such configuration applies to all configurations of the subject technology. A disclosure relating to a configuration may apply to all configurations, or one or more configurations. A configuration may provide one or more examples. A phrase such a configuration may refer to one or more configurations and vice versa.

The word "exemplary" is used herein to mean "serving as an example or illustration." Any aspect or design described herein as "exemplary" is not necessarily to be construed as preferred or advantageous over other aspects or designs.

All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112, sixth paragraph, unless the element is expressly recited using the phrase "means for" or, in the case of a method claim, the element is recited using the phrase "step for." Furthermore, to the extent that the term "include," "have," or the like is used in the description or the claims, such term is intended to be inclusive in a manner similar to the term "comprise" as "comprise" is interpreted when employed as a transitional word in a claim.

What is claimed is:

1. A sports helmet, comprising:

a main shell;

a coupler connected to the main shell, wherein the coupler defines an axis transverse to a surface of the main shell; and a recoil based shock absorber system coupled to the main shell via the coupler, the recoil based shock absorber system comprising:

a radial spring element disposed radially with respect to the axis of the coupler, and an axial spring element disposed axially with respect to the axis of the coupler, wherein the recoil based shock absorber system is configured to move omnidirectionally in response to an impact force received by an element connected to the coupler.

2. The sports helmet of claim 1, wherein the radial spring element is a disk comprising multiple layers arranged annularly around a central point of the disk.

3. The sports helmet of claim 2, wherein the multiple layers comprise layers of increasing stiffness, strength, and/or toughness the farther one of the multiple layers is from the central point of the disk.

4. The sports helmet of claim 1, wherein the radial spring element is a disk comprising a plurality of wedge sections around a central point of the disk.

5. The sports helmet of claim 1, wherein the radial spring element is a disk comprising a plurality medusoid based arc sections of spring links around a central point of the disk.

6. The sports helmet of claim 1, further comprising a pair of opposingly positioned dashpots within a sleeve of the axial spring element.

7. The sports helmet of claim 6, wherein the pair of opposingly positioned dashpots are configured spaced in a default position and to move toward each other in response to the impact force.

8. The sports helmet of claim 6, wherein the pair of opposingly positioned dashpots are positioned in contact with each other in a default position and configured to move away from each other in response to the impact force received.

* * * * *